United States Patent [19]

Chiu

[11] Patent Number: 4,863,622

[45] Date of Patent: Sep. 5, 1989

[54] PHOSPHORUS-FREE ANTIWEAR/ANTIFRICTION ADDITIVES

[75] Inventor: I.-Ching Chiu, Houston, Tex.

[73] Assignee: Pennzoil Products Company, Houston, Tex.

[21] Appl. No.: 177,912

[22] Filed: Mar. 31, 1988

[51] Int. Cl.[4] ..... C10M 135/22

[52] U.S. Cl. ..... 252/47.5; 252/48.6; 558/255; 558/256

[58] Field of Search ..... 252/47.5, 48.6; 558/255, 256

[56] References Cited

U.S. PATENT DOCUMENTS

| | | | |
|---|---|---|---|
| 2,344,393 | 3/1944 | Cook et al. | 252/32.7 E |
| 2,588,273 | 3/1952 | Morway et al. | 252/48.6 |
| 2,673,839 | 3/1984 | Kirshenbaum et al. | 252/47.5 |
| 3,041,284 | 6/1962 | Calhoun | 252/48.6 |
| 3,156,649 | 11/1964 | Hewett et al. | 252/48.6 |
| 3,312,620 | 4/1967 | Low et al. | 252/47.5 |
| 3,320,300 | 5/1967 | Doss | 260/455 |
| 3,546,117 | 12/1970 | Anderson | 252/47.5 |
| 3,565,942 | 2/1971 | Krimmel | 558/256 |
| 3,833,496 | 9/1974 | Malec | 252/33.6 |
| 4,019,991 | 4/1977 | Jayne et al. | 252/48.2 |
| 4,031,023 | 6/1977 | Musser et al. | 252/48.2 |
| 4,209,410 | 6/1980 | Baldwin | 252/48.2 |
| 4,217,233 | 8/1980 | Michaelis | 252/48.2 |
| 4,246,127 | 1/1981 | Michaelis et al. | 252/48.2 |
| 4,549,974 | 10/1985 | Horodysky | 252/33.6 |
| 4,684,459 | 8/1987 | Klimpel | 558/256 |

FOREIGN PATENT DOCUMENTS

| | | | |
|---|---|---|---|
| 70860 | 5/1982 | Japan | 558/256 |

*Primary Examiner*—William R. Dixon, Jr.
*Assistant Examiner*—Jerry D. Johnson
*Attorney, Agent, or Firm*—Lowe, Price, LeBlanc, Becker & Shur

[57] ABSTRACT

A phosphorous free antiwear/antifriction additive for lubricant oil is described. The additive is a fatty acid thio ester or a dialkyl disubstituted fatty acid thio amine having the formula of

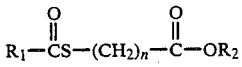

or

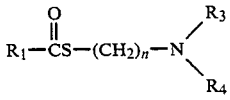

wherein $R_1$ is a saturated or unsaturated hydrocarbon having 8 to 40 carbon atoms;

$R_2$, $R_3$ and $R_4$ are hydrocarbons having 1 to 4 carbon atoms; and n=1 to 4.

20 Claims, No Drawings

PHOSPHORUS-FREE ANTIWEAR/ANTIFRICTION ADDITIVES

FIELD OF THE INVENTION

This invention relates to wear and friction reducing additives for lubricants, and in particular to additives which do not contain phosphorus or heavy metals.

BACKGROUND OF THE INVENTION

For many years, zinc dialkyl dithiophosphates (ZDDP) have been used as antiwear/antioxidant additives in lubricant oils. However, the use of ZDDP is accompanied by a number of substantial drawbacks, e.g., (1) ash formation, (2) glazing of the exhaust catalysts by zinc pyrophosphate, a result of noncombusted ZDDP in the blowby, and (3) antagonistic interactions between ZDDP and other additives such as the succinimide polyamine dispersants.

It has been known for some time that a hydrocarbon containing a sulfur atom in the backbone of the hydrocarbon chain and ending with a polar group will exhibit wear mitigating properties. See for example B. A. Baldwin, ASLE Trans, 1985, 28, PP 381–8. See also European Pat. No. 165670 and U.S. Pat. No. 4,217,233. The European patent describes a thio ester prepared by the reaction of a mercaptoethanol with coconut oil and the above U.S. patent provides an acetate prepared from the reaction from episulfide with mercaptoglycolate.

It is also known that cetain N,N-disubstituted amides are effective in lubricant base stocks. See U.S. Pat. No. 3,312,620.

Furthermore, as described in U.S. Pat. No. 2,673,839, condensation products of a thiocarbamic acid or salt thereof and a sulfide of a halogen substituted low molecular weight, saturated fatty acid halide and a carboxylic ester will inhibit oxidation in motor oil and are effective in dispersing sludge. As is well known, oxidation products in motor oil can be corrosive and cause excessive wear of metal engine parts. The presence of the halogen however is required in the sulfide in order to form the condensation product. There is no indication in that patent that an unsubstituted fatty acid sulfide ester alone would be effective for any purpose.

SUMMARY OF THE INVENTION

It is now been discovered that certain fatty acid thio esters and dialkyl disubstituted fatty acid thioamines provide excellent antiwear properties and can be substituted for ZDDP in lubricants to reduce the concentration of ZDDP substantially. These compounds preferably are formed as the reaction products of a fatty acid with the appropriate mercapto ester or amino alkyl thiol. In tests conducted both in mineral oil and fully formulated lubricating oil, excellent antiwear and antifriction properties were exhibited.

Accordingly it is an object of this invention to provide antiwear/antifriction additives for lubricating oil which do not contain phosphorus or heavy metals.

It is another object of this invention to provide sulfur-containing hydrocarbon compounds which are formulated from relatively inexpensive fatty acids and which produce products having excellent antiwear and antifriction properties.

It is still another object of this invention to provide sulfur-containing fatty acid esters and sulfur containing fatty acid disubstituted amines as additives for lubricants to replace conventional phosphorous containing antiwear additives.

It is still another object of this invention to provide a lubricant which is phosphorous free and which will exhibit excellent antiwear and antifriction properties.

Other objects and advantages of the invention will become apparent as the description thereof proceeds.

DESCRIPTION OF PREFERRED EMBODIMENTS

As pointed out above, this invention is concerned with a novel series of compounds which do not contain phosphorous and which have useful antiwear and antifriction properties.

The compound of this invention have the following structural formulae:

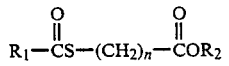

I

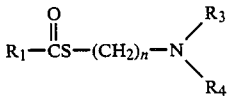

II where $R_1$ is a saturated or unsaturated hydrocarbon having 8 to 40 carbon atoms;

$R_2$, $R_3$, and $R_4$ are hydrocarbons having from 1 to 4 carbon atoms; and n is an integer of 1 to 4.

In these compounds $R_1$ is preferably a straight or branch-chained alkyl, alkenyl, or alkynyl group or an aryl group which may be further substituted by alkyl of 1 to 7 carbon atoms. $R_2$, $R_3$ and $R_4$ are preferably alkyl or alkenyl of 1 to 4 carbon atoms. In a preferred embodiment (Method A) the compounds of this invention are prepared by the reaction of fatty acids with appropriate mercaptans in the presence of an acid activating agent, such as a polyphosphate ester (ppe), or fatty acid chlorides with appropriate mercaptans in the presence of an organic or inorganic base, as shown below:

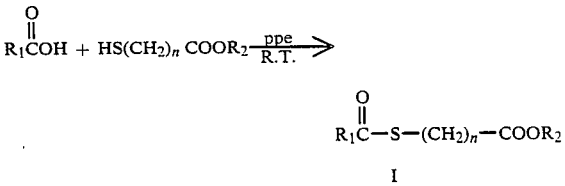

I

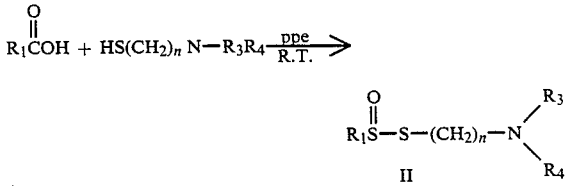

II

As will be observed from the above reactions, the thiol esters I are prepared by methods known in the literature, described for example in *Organic Synthesis*, volume III, page 458; volume IV, page 669. In the procedure of this invention, the thiol esters are preferably prepared using the procedure of Tsuneo et al, in *Synthesis*, page 134 (1982). In this process the fatty acid is reacted with an alkyl thiolglycolate in the presence of an activating agent such as a polyphosphate ester in a solvent such as chloroform. The reaction is carried out preferably with agitation at room temperature over a period of time to produce the product. The mixture is then diluted with a solvent such as an aliphatic hydrocarbon and then neutralized with a base. The organic layer is then washed with an aqueous base and dried to provide the thio ester product.

In an alternative procedure, the thio esters may be prepared from the corresponding fatty acid chloride by adding the fatty acid chloride contained in a solvent such as benzene to an agitated solution of the akylthioglycolate in the presence of an activating agent such as a triethylamine. The resulting reaction mixture will then be diluted with an aliphatic hydrocarbon solvent, filtered and dried.

The corresponding amines are prepared by reaction of the fatty acid or fatty acid chloride with a substituted amine alkylenethiol hydrochloride. The reaction is carried out in generally the same manner.

Preferably the compounds of this invention are made utilizing low cost fatty acids such as oleic acid, tall oil and the like. In the preferred embodiment of this invention oleic acid is reacted with an appropriate mercaptoglycolate, or with N,N-dimethyl aminoethanethiol, respectively.

The oleoyl esters and amine compounds of the present invention are useful for incorporation into motor oils and other lubricating compositions to provide low phosphorous and low ash motor oils and lubricants. Thus these compounds serve as a comparable replacement for a portion or all zinc diakyl diothio phosphates in the preparation of low phosphorous and low ash motor oils and lubricants. The compounds provide excellent anti-wear and anti-friction characteristics to lubricating compositions. They also make lubricating oils such as motor oils more environmentally acceptable since the phosphorous additive ZDDP has been known to poison automobile catalytic converters. Accordingly by the present invention, excellent anti-wear and anti-friction properties are provided to lubricating compositions such as motor oils by incorporation of the anti-wear and anti-friction compounds of the present invention.

The following examples are preferred methods for synthesizing compounds of this invention. The examples set forth are intended to be illustrative however and not limitive of this invention. In these examples and elsewhere in the application, parts are by weight unless otherwise indicated.

EXAMPLE I

Methyl 2-(1-oleoylthio)acetate

METHOD A.

The title compound was prepared by using the procedure described by Imamoto Tsuneo and coworkers in *Synthesis*, 134 (1982). The acid activating agent, polyphosphate ester (PPE) was prepared from $P_2O_5$ and ether using the described method [(W. Pollmann and G. Schramm, Biochimica ET Biophysica Acta, 80 pp. 1–7 (1964)].

A reaction solution of oleic acid (5.62 g, 20 mmol), methyl thioglycolate (2.12 g, 20 mmol) and polyphosphate ester (29 g) in $CHCl_3$ (10 ml) was stirred at room temperature for 6 hours. The reaction was diluted with hexane (250 ml), followed by slow neutralization with saturated aqueous $NaHCO_3$. The separated organic layer was again washed with saturated aqueous $NaHCO_3$ (50 ml). After drying over anhydrous $MgSO_4$ and solvent evaporation, the organic layer gave 7.10 grams (96% yield) of the title compound, as a pale yellowish liquid.

EXAMPLE II

Methyl 2-(1-oleoylthio) acetate

METHOD B.

A solution of oleoyl chloride (8.02 g of 75% purity, 20 mmol) in benzene (10 ml) was added dropwise to a stirred solution of methyl thioglycolate (2.12 g, 20 mmol) and triethylamine (4.2 ml, 35 mmol) in benzene (30 ml) at room temperature. After stirring for three hours, the reaction mixture was diluted with 200 ml hexane and then filtered through silica gel (−50 g). The filtrate was evaporated to dryness under reduced pressure and the remaining residue was further purified by $SiO_2$ column chromatography to give the title compound, as a colorless liquid, in 70% yield (5.18 g).

EXAMPLE III

Mercapto Ester of Tall Oil

In this example, the procedure of Example I, Method A, was followed except that 5.62 grams of tall oil was substituted for oleic acid. The reaction gave 6.84 grams (93% yield) of desired product.

EXAMPLE IV

N,N-Dimethyl(1-oleylthio)ethylamine

METHOD A.

In this example, the procedure of Example I, Method A, was followed except that 2-dimethylaminoethanethiol hydrochloride (2.82 g, 20 mmol) was substituted for the methyl thioglycolate. The reaction gave the title compound in 88% yield (6.51 grams).

EXAMPLE V

N,N-Dimethyl(1-oleylthio)ethylamine

METHOD B.

To a suspension of 2-dimethylaminoethanethiol hydrochloride (1.62 g, 10 mmol) and triethylamine (3.36 ml, 24 mmol) in benzene (30 ml) at room temperature was added dropwise a solution of oleoyl chloride (75% purity; 4.30 g, 10 mmol) in benzene (10 ml). After stirring for three hours, the reaction mixture was partitioned between hexane (200 ml) and $H_2O$ (100 ml). The organic layer was separated and evaporated to dryness. The residue was chromatographed on a $SiO_2$ column to give the title compound as a pale yellow liquid, in 60% yield (2.22 g).

EXAMPLE VI

N,N-Dimethylaminoethane Mercapto Ester of Tall Oil

In this example, the procedure of Example I, Method A, was followed except that tall oil (5.62 g, 20 mmol) and 2-dimethylaminoethanethiol hydrochloride (2.82 g, 20 mmol) were used. The reaction gave 7.17 grams of desired product (97% yield).

EXAMPLE VII

Hydroxyhydrocarbyl Mercapto Ester of Lauric Acid

(Comparative Exaple)

In this Example, a product of European Pat. No. 165670 was prepared for comparative purposes.

2-Mercaptoethanol (2.34 g, 30 mmol) was added in one portion to a suspension of $K_2CO_3$ (4.15 g) in hexane (60 ml) at room temperature. After stirring for 30 minutes, the reaction was cooled at ice-bath temperature, and a lauroyl chloride (6.57 g, 30 mmol) in hexane (220 ml) solution was added dropwise over a 1 hour period. The reaction mixture was stirred for an additional 1 hour at ice-bath temperature before quenching with saturated aqueous $NaHCO_3$ (30 ml). The organic layer was separated and rewashed with aqueous $NaHCO_3$ (30 ml). The organic layer was separated, dried over anhydrous $K_2CO_3$ and evaporated. The remaining residue was chromatographed on a $SiO_2$ column to give the desired compound which was fully characterized by IR, NMR, and mass spectra. IR (neat): 3156 $cm^{-1}$, 1695 $cm^{-1}$; $^{13}C$ NMR ($CDCl_3$): 173.5, 61.9, 434.2 ppm; $^1H$ NMR ($CDCl_3$): δ 3.76 (t, 2H), δ 3.08 (t, 2H), δ 2.58 (t, 2H), δ 2.24 (broad S, 1H, exchanged with $D_2O$), δ 1.67 (m, 4H), δ 1.26 (broad S, 16 H) and δ 0.88 (t 3H); Mass: m/e at 244 ($M^+$), 215 ($M^+$—$CH_2CH_2OH$), 183 ($M^+$—$SCH_2CH_2OH$).

EXAMPLE VIII

2-(Tetradecylthio)ethanol

(Comparative Example)

In this Example, a product of U.S. Pat. No. 4,209,410 was prepared for comparative purposes.

A reaction solution of α-tetradecene (5.89 g, 30 mmol), mercaptoethanol (2.34 g, 30 mmol) and a catalytic amount of t-butyl peroxide (0.2 ml) in xylene (40 ml) was refluxed under $N_2$ for 18 hours. After cooling to room temperature, the reaction solution was partitioned between hexane (100 ml) and saturated aqueous $NaHCO_3$ (30 ml). The organic layer was separated, dried over anhydrous $K_2CO_3$ and evaporated. The remaining residue was chromatographed on $SiO_2$ to give the title compound which has been fully characterized by IR, NMR, and mass spectra. IR (neat): 3352 $cm^{-1}$; $^{13}C$ NMR ($CDCl_3$): 60.37, 35.38 ppm; $^1H$ NMR ($CDCl_3$): δ3.72 (m, 1H, exchanged with $D_2O$), δ2.73 (5, 2H), δ2.53 (t, 2H), δ1.12–1.69 (m, 26H), and δ0.89 (t, 3H); Mass: m/e at 274 ($M^+$), 256 ($M^+$)—$H_2O$), 243 ($M^+$—$CH_2OH$), 229 ($M^+$—$CH_2CH_2OH$).

The antiwear properties of the compounds of this invention were compared to those of ZDDP and compounds described in European Pat. No. 165670 and U.S. Pat. No. 4,209,410. The tests were performed using an antiwear/antifriction effective amount of compounds of this invention in both Chevron 100 Neutral base oil and fully formulated 5W-30 oil without ZDDP in the ASTM D-4172 four-ball wear test. The compounds of this invention also produce a lower wear scar than that described in European Pat. No. 165670 and U.S. Pat. No. 4,209,410 which have been proven to have better antiwear properties than ZDDP. The results of these test are set forth in Tables I and II below. The friction properties of the compounds of this invention were evaluated in fully formulated 5W-30 oil and compared with the commercial friction modifier —Sul Perm 307 in Optimal SRV machine. Results are given in Table III below. The ASTM D-130 copper strip corrosion tests were also performed. These tests were conducted in fully formulated 5W-30 oil and the results thereof are given in the Tables set forth below.

TABLE I

ASTM D-4172 Four-Ball Wear Scar (mm) of Additives in Chevron 100N Base Oil (40 kg × 1200 rpm × 75° C. × 1 hour)

| Additives | Wt % | Wear Scar (mm) |
|---|---|---|
| None | — | Seized |
| Example I | 2.0 | 0.40 |
| Example III | 2.0 | 0.59 |
| Example IV | 2.0 | 0.50 |
| Example VI | 2.0 | 0.52 |
| Example VII (EP 165,670) | 2.0 | 0.68 |
| Example VIII U.S. Pat. No. 4,209,410) | 2.0 | 0.88 |
| ZDDP | 2.0 | 0.65 |

TABLE II

ASTM D-4172 Four-Ball Wear Scar of Additives in Fully Formulated 5W-30 (without ZDDP) (40 kg × 1200 rpm × 75° C. × 1 hour)

| Additives | Wt % | Wear Scar (mm) In house* | Wear Scar (mm) SRI** |
|---|---|---|---|
| Example I | 2.0 | 0.46 | 0.37 |
| Example IV | 2.0 | 0.41 | 0.32 |
| ZDDP | 2.0 | 0.50 | 0.38 |

*Average value of four runs
**SRI: Southwest Research Institute

TABLE III

Friction Coefficient of Additives in Fully Formulated Oil (without Friction Modifier) (Optimol SRV Test: Load, 200 N; Frequence, 40 HZ; Stroke, 2.50 mm; Temperature, 100° C.; Time, 60 minutes)

| Additives | Wt % | Friction Coefficient |
|---|---|---|
| Example I | 2.0 | 0.139 |
| Example III | 2.0 | 0.145 |
| Example IV | 2.0 | 0.129 |
| Example VI | 2.0 | 0.137 |
| Sul-Perm 307 | 2.0 | 0.144 |

TABLE IV

ASTM D-130 Corrosion Test of Additives in Fully Formulated Oil (at 125° C.)

| Additives | Wt % | Time (h) | Result |
|---|---|---|---|
| Example I | 1.0 | 3 | 1A |
| Example I | 1.0 | 72 | 2E |
| Example IV | 1.0 | 3 | 1A |
| Example IV | 1.0 | 72 | 3A |

In the following evaluation, the wear prevention characteristics of Methyl 2-(1-oleoylthio) acetate (Example I) was evaluated in the ASTM III-D wear screener test. The test was done at EG&G Automotive Research, Inc., and was performed at 1 wt% of the additive in an experimental 10W-30 oil. The results of comparisons among the experimental oil with and without additive, reference oil REO 400 (a 10W-30 SF/CD oil), and two other commercial motor oils are given in the following Table V.

In summary, it has been discovered that certain fatty acid thio esters and disubstituted alkyl thio amines are highly effective antiwear/antifriction agents in lubricating oil and can be used to substitute for conventional phosphorus or heavy metal containing antiwear additives. The additives of this invention do not have the disadvantage of poisoning catalytic converters or the like when used in automobile engines. The compounds of this invention produce phosphorus free or low phosphorous and low ash motor oils and can be formulated with conventional motor oil additives such as detergents, viscosity index improvers, dispersants, antioxidants and pour point dispersants. While the test used preferred concentrations of 2.0 weight percent, the compounds of this invention can be used in concentrations of from 0.1 to at least 5 percent by weight.

In this patent application, particularly in Tables I, II, III and IV, reference is made to ASTM and Optimol SRV test methods. These test methods are known in the art and are as follows:

ASTM D 4172-82—Four Ball Method

This method covers a procedure for making a preliminary evaluation of the antiwear properties of fluid lubricants by means of the four-ball wear test machine. It is used to determine the relative wear preventive properties of lubricating fluids under the prescribed test conditions. For this method, three steel balls are clamped together and covered with a lubricant to be evaluated. A fourth ball is pressed with a force into the cavity formed by the three clamped balls for "three-point contact." The temperature of the test lubricant is regulated, and the top ball is rotated for one hour. Lubricants are compared by measuring the average size of the scar diameter worn on the three lower clamped balls.

TABLE V

ASTM III-D Wear Screener Tests

| Cam + Lifter Wear ($10^{-4}$ in.) | Experimental 10W-30 Oil | Experimental 10W-30 Oil Plus 1 wt % of Example I | REO 400 (15 tests) | Commercial Motor Oil A | Commercial Motor Oil B |
|---|---|---|---|---|---|
| Maximum[1] | 61 | 26 | 50.10 ± 16.2 (43 ± 19)[2] | 15 | 56 |
| Average[1] | 31 | 18 | 23.8 ± 11 (19 ± 9)[2] | 10 | 15 |
| Minimum | 7 | 13 | 8.50 ± 4.5 (6 ± 3.5)[2] | 1 | 1 |

[1]III-D Passing Limits: Avg. ≦40, Max. ≦60.
[2]Industry data from the standard 64-hour ASTM III-D test are shown in parentheses.

ASTM D 130-74—Copper Corrosion Test

This method covers the detection of the corrosiveness to copper of lubricating oils and other petroleum products. A polished copper strip is immersed in the sample and heated for a time. Then the strip is compared to an ASTM corrosion standard.

Optimol SRV (Friction and Wear) Test

This method is also used to determine the relative wear preventive properties of lubricating fluids under prescribed test conditions. The tribocontact is subjected to a reciprocating motion and has three configurations; point contact, line contact, and surface contact. A Pennzoil specimen holder allows sliding of an actual piston ring on a disk of liner material.

In addition, in Table III, the compositions of the invention are compared with the commercial product Sul-Perm 307. Sul-Perm 307 is a stable sulfurized, transesterified triglyceride containing a unique mixture of poly- and monounsaturated, monobasic acids in which most of the free acid has been esterified with selected monoalcohols. Typical properties are as follows:

| Properties | Typical |
|---|---|
| Viscosity, SUS at 210° F. | 70 |
| Specific Gravity, @ 60° F. | 0.94 |
| Weight, lbs./gal. @ 60° F. | 7.8 |
| Sulfur, (w) % | 6 |
| Copper Strip (10%) | 1b |
| Acid No. | 10 |
| Pour Point, °F. | 40 |
| Flash Point, °F., COC | 320 |

The invention may be embodied in other specific forms without departing from the spirit or essential characteristics thereto. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A composition comprising a lubricant oil and an antiwear/antifriction effective amount of a compound having the structural formula, selected from the group consisting of:

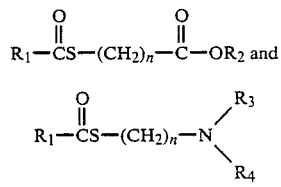

wherein $R_1$ is a saturated or unsaturated hydrocarbon having 8 to 40 carbon atoms;

$R_2$, $R_3$ and $R_4$ are hydrocarbons having 1 to 4 carbon atoms; and n=an integer of 1 to 4.

2. The composition of claim 1 wherein said compound is present in a concentration of 0.1 to about 5 percent by weight.

3. The composition of claim 2 wherein said compound is present in a concentration of 1 to 2.5 percent.

4. The composition of claim 1 wherein $R_1$ is an unsaturated hydrocarbon having 10 to 20 carbon atoms.

5. The composition of claim 1 wherein the compound is of the formula:

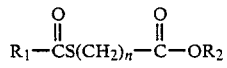

wherein $R_1$, $R_2$ and n are as defined in claim 1.

6. The composition of claim 5 wherein $R_1$ is a hydrocarbon of 18 carbon atoms, $R_2$ is methyl, and n is 1.

7. A composition comprising a lubricant oil and an antiwear/antifriction effective amount of a compound having the structural formula

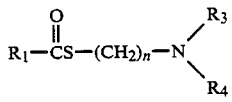

wherein $R_1$ is a saturated or unsaturated hydrocarbon having 8 to 40 carbon atoms;

$R_3$ and $R_4$ are hydrocarbons having 1 to 4 carbon atoms; and n=an integer of 1 to 4.

8. The composition of claim 7 wherein $R_1$ is a hydrocarbon of 18 carbon atoms, $R_3$ and $R_4$ are methyl and n is 1.

9. A method for enhancing the antiwear properties of a lubricant composition comprising adding to a lubricant oil an antiwear effective amount of a compound having the structural formula selected from the group consisting of:

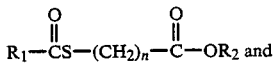

and

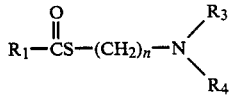

wherein $R_1$ is a saturated or unsaturated hydrocarbon having 8 to 40 carbon atoms;

$R_2$, $R_3$ and $R_4$ are hydrocarbons having 1 to 4 carbon atoms; and n=an integer of 1 to 4.

10. The method of claim 9 wherein said compound is present in a concentration of 0.1 to about 5 percent by weight.

11. The method of claim 10 wherein said compound is present in a concentration of 1 to 2.5 percent.

12. The method of claim 9 wherein $R_1$ is an unsaturated hydrocarbon having 18 carbon atoms.

13. The method of claim 12 wherein $R_1$ is a hydrocarbon of 18 carbon atoms, $R_2$ is methyl, and n is an integer of 1 to 4.

14. The method of claim 9 wherein the effective compound is of the structural formula:

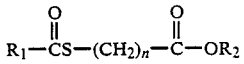

wherein $R_1$, $R_2$ and n are as defined in claim 9.

15. A method for enhancing the antiwear properties of a lubricant composition comprising adding to a lubricant oil an antiwear effective amount of a compound having the structural formula

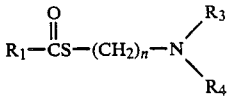

wherein $R_1$ is a saturated or unsaturated hydrocarbon having 8 to 40 carbon atoms;

$R_3$ and $R_4$ are hydrocarbons having 1 to 4 carbon atoms; and n=an integer of 1 to 4.

16. The method of claim 15 wherein $R_1$ is a hydrocarbon of 18 carbon atoms, $R_3$ and $R_4$ are methyl and n is 1.

17. A compound having the formula:

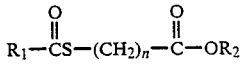

wherein $R_1$ is a saturated or unsaturated hydrocarbon having 8 to 40 carbon atoms;

$R_2$ is a hydrocarbon having 1 to 4 carbon atoms; and n=an integer of 1 to 4.

18. A compound according to claim 17 wherein $R_1$ is an aliphatic hydrocarbon of 10 to 20 carbon atoms.

19. A compound according to claim 17 wherein $R_1$ is derived from oleic acid or tall oil.

20. A compound according to claim 17 wherein $R_1$ is derived from oleic acid, $R_2$ is methyl and n is 1.

* * * * *

UNITED STATES PATENT AND TRADEMARK OFFICE

CERTIFICATE OF CORRECTION

PATENT NO. : 4,863,622

DATED : September 5, 1989

INVENTOR(S) : I.-Ching Chiu

It is certified that error appears in the above-identified patent and that said Letters Patent is hereby corrected as shown below:

Column 4, line 17, "(—50g)" should be --(50g)--.

Column 5, line 26, "($M^+$—$CH_2CH_2OH$)" should be --($M^+$-$CH_2CH_2OH$)--;

line 27, "($M^+$—$SCH_2CH_2OH$)" should be --($M^+$-$SCH_2CH_2OH$)--;

line 49, "($M^+$)—$H_2O$)" should be --($M^+$-$H_2O$)--;

line 50, "$M^+$—$CH_2OH$), 229($M^+$—$CH_2CH_2OH$)", should be --($M^+$-$CH_2OH$), 229($M^+$-$CH_2CH_2OH$)--;

line 67, "Optimal", should be --Optimol--.

Column 6, Table III, line 36, "40 HZ", should be --40 $H_Z$--;

line 55, "Methyl", should be --methyl--.

Signed and Sealed this

Fourth Day of December, 1990

*Attest:*

HARRY F. MANBECK, JR.

*Attesting Officer*

*Commissioner of Patents and Trademarks*